United States Patent [19]

Körner et al.

[11] Patent Number: 4,930,471

[45] Date of Patent: Jun. 5, 1990

[54] ENGINE-BRAKING DEVICE FOR INTERNAL-COMBUSTION ENGINE

[75] Inventors: Wolf-Dietrich Körner, Remseck; Thomas Harr, Tiefenbronn, both of Fed. Rep. of Germany

[73] Assignee: Daimler-Benz AG, Stuttgart, Fed. Rep. of Germany

[21] Appl. No.: 430,650

[22] Filed: Oct. 31, 1989

[30] Foreign Application Priority Data

Nov. 23, 1988 [DE] Fed. Rep. of Germany ..... 3839452

[51] Int. Cl.[5] ..... F01M 1/00

[52] U.S. Cl. ..... 123/196 R; 123/320

[58] Field of Search ..... 123/196 R, 196 CP, 320

[56] References Cited

U.S. PATENT DOCUMENTS 4,493,295 1/1985 Ampferer ..... 123/196 CP 4,649,873 3/1987 Amano ..... 123/196 R 4,729,349 3/1988 Sonoda et al. ..... 123/196 R

FOREIGN PATENT DOCUMENTS 3346371 7/1985 Fed. Rep. of Germany .

3428626 2/1986 Fed. Rep. of Germany .

*Primary Examiner*—E. Rollins Cross

*Attorney, Agent, or Firm*—Evenson, Wands, Edwards, Lenahan & McKeown

[57] ABSTRACT

The invention relates to an internal-combustion engine-braking device and comprises a throttle valve actuated by a control piston both of which are arranged in a controlled bore in a cylinder head. To ensure lubrication of the control piston in a simple way, the control bore is equipped with a connecting orifice to the oil return bore leading from the engine rocker-arm space into the crankcase.

4 Claims, 1 Drawing Sheet

ENGINE-BRAKING DEVICE FOR INTERNAL-COMBUSTION ENGINE

BACKGROUND AND SUMMARY OF THE INVENTION

The invention relates to an engine-braking device for an internal-combustion engine which comprises a throttle valve arranged in the cylinder head of the engine to control a throttle port located between the cylinder and an outlet channel. A control piston for actuating the throttle valve is inserted in a control bore in a cylinder head and is subjected to compressed air during the braking operation. Bearings for rocker arms, arranged in a rocker-arm space in the cylinder head for actuating the gas exchange valves, are lubricated with lubricating oil from the lubricating-oil circuit of the internal-combustion engine. Lubricating oil dripping out of the bearings into the rocker-arm space is diverted through an oil return bore into the engine crankcase.

An engine-braking device of this general type is known from German Offenlegungsschrift No. 3,428,626. There a controlled piston is inserted in the control bore of the cylinder head and is actuated by means of compressed air. As a result of the high opening and closing speed of the control piston, relatively high frictional resistances arise between the piston and the bore wall. This structure provides a real danger in that the control piston can jam in the control bore.

The object on which the instant invention is based is to design the engine brake throttle valve in a constructionally simple way that its functioning and stability under load are improved substantially.

The object is achieved by having the oil return bore from the rocker arm space in the cylinder head have a connection to the control bore through an orifice.

As a result of the invention, lubrication of the control pistons is obtained in a simple way, without any additional construction outlay, by branching off some of the lubricating oil flowing out of the rocker-arm space into the crankcase and into the control bore. The lubrication achieves an increase in the stability under load, since the friction between the piston and control bore is reduced and a jamming of the piston in the control bore is largely prevented. Moreover, lubrication ensures an additional cooling effect on the control piston, as a result of which, the wear of a sealing ring arranged or the control piston decreases, thus likewise contributing to an improvement of the stability under load.

Connecting the oil return bore and the control bore also achieves a venting of the space located under the control piston, and therefore there is no need to make a special venting bore.

It is also advantageous if the control piston is stepped and has a sealing portion and guide portion. Here a connecting orifice is provided in a wall of the control bore adjacent to the guide portion. The control bore and the oil return bore are so arranged relative to one another, that the oil return bore intersects the control bore and with a common intersection line forming the edge of the connecting orifice.

Other objects, advantages and novel features of the present invention will become apparent from the following detailed description of the invention when considered in conjunction with the accompanying drawings.

DETAILED DESCRIPTION OF THE DRAWINGS

Figure 1:
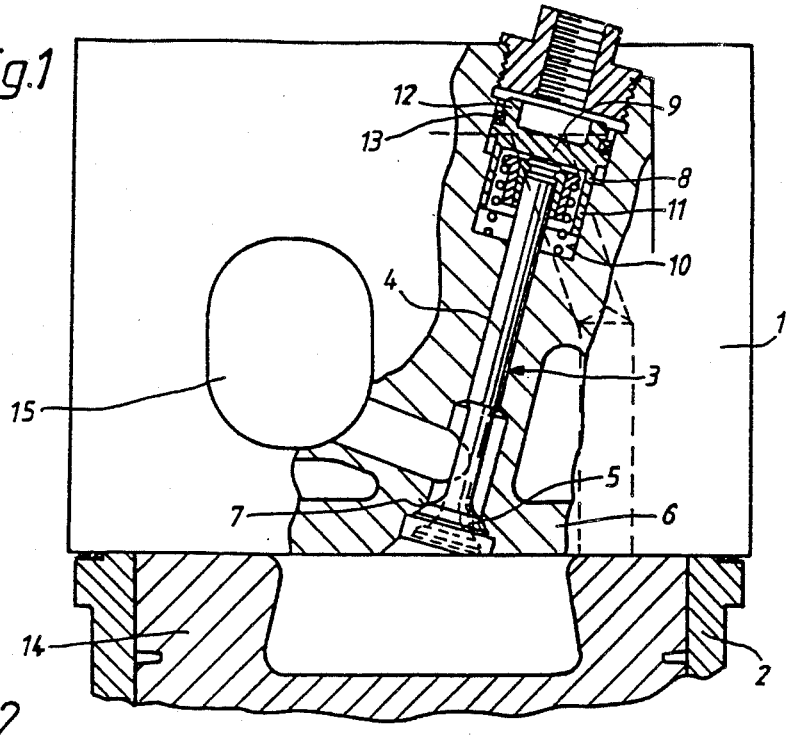
FIG. 1 shows an engine-braking throttle valve with a control piston in a cross-section through the cylinder-head of an internal-combustion engine.

FIG. 1 shows a cylinder head 1 of a diesel internal-combustion engine along with a cylinder 2. In addition to the normal inlet and exhaust gas exchange valves (not shown), the cylinder head 1 contains a throttle valve 3 for each cylinder head 2. The throttle valve 3 is designed as a disc valve and is guided in the cylinder head 1 by means of its valve stem 4. Disc 5 controls a throttle port 7 located in the cylinder-head 1 bottom. The throttle valve 3 is actuated by a control piston 8. The piston 8 rests with its base plate 9 on the end of the valve stem 4 and is inserted in a stepped control bore 10 of the cylinder head 1. The control piston 8 is stepped similarly to the bore and is guided in the narrowed part of the control bore 10 by means of a guide portion 11. The piston 8 is sealingly held in the widened part of the control bore by a sealing ring 13 arranged on the upper portion 12. The control piston 8 is adjusted by means of compressed air by a braking control valve which, at the start of the braking operation, subjects the top side of the control piston 8 to pressure. This causes the throttle valve 3 to open so that the gas, compressed in a cylinder 2 by the piston 14, is displaced through the throttle port 7 into the outlet channel 15.

Figure 2:
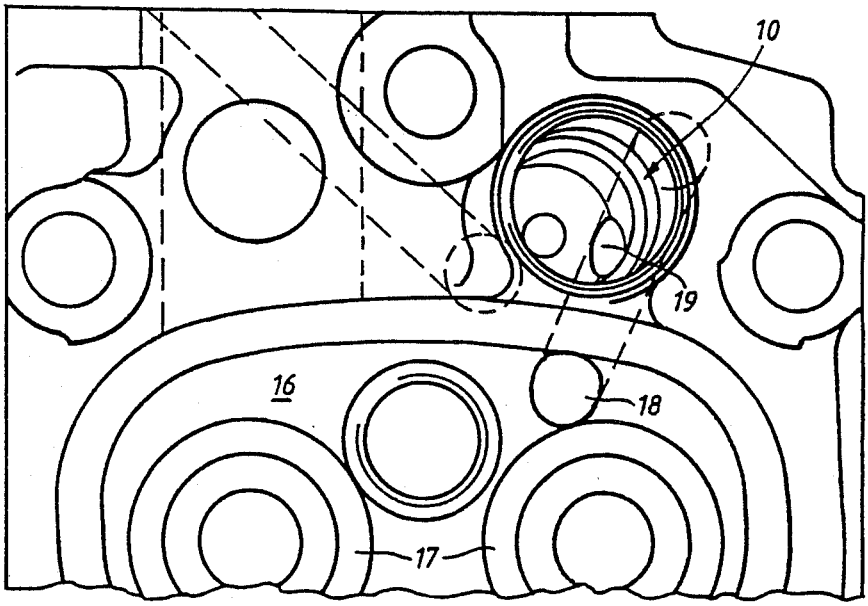
FIG. 2 shows a top view of the position of the control bore for guiding the control piston in the cylinder head of FIG. 1.

It can be seen from FIG. 2 that the control bore 10 is provided next to a rocker-arm space 16. Receiving bores 17 for the gas exchange valves (not shown) are arranged in the rocker-arm space 16 which contains the rocker arms (not shown) for actuating the gas exchange valves. The rocker-arms are mounted on rocker shafts and are lubricated with lubricating oil from the lubricating-oil circuit. The lubricating oil dripping out of the bearings into the rocker-arm space 16 is diverted through an oil return bore 18 into the crankcase.

According to the invention, the oil return bore 18 connects with the control bore 10 through a connecting orifice 19. As a result, the control piston 8 in the control bore 10 is lubricated in a constructionally simple way by some of the lubricating oil diverted from the rocker-arm space 16 into the crankcase. In order to ensure a controlled lubrication of the guide portion 11 on the control piston 8, the connecting orifice 19 is provided in the narrowed part of the control bore 10. The space located under the control piston 8 is thereby vented towards the crankcase via the connecting orifice 19.

As shown in FIG. 2, the position of the control bore 10 is coordinated with the path of the oil return bore 18 in such a way that the oil return bore 18 intersects the control bore 8 in the narrowed bore part. The common intersection line, obtained thereby, forms the edge of the connecting orifice 19. This connection between the bores 10 and 18 is made in the most confined space possible and without an additional connecting duct.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. Engine-braking device for an internal-combustion engine, comprising:

a throttle valve means, arranged in a cylinder head of the engine;

the throttle valve means controlling a throttle port located between a cylinder and an outlet channel;

a control piston means for actuating the throttle valve;

said control piston being inserted in a control tore in the cylinder head and subjected to compressed air during a braking operation;

said cylinder head being provided with a rocker-arm space means for housing rocker arms of the engine which are provided with bearings lubricated with lubricating oil from a lubricating-oil circuit of the internal-combustion engine;

wherein lubricating oil drips out the bearings into the rocker-arm space and is diverted through an oil return bore into the engine crankcase; and wherein the oil return bore is provided with a connecting orifice to the control bore.

2. Engine-braking device according to claim 1, wherein the control piston is stepped and has a sealing portion and guide portion; and wherein the connecting orifice is provided in a wall of the control bore adjacent to the guide portion.

3. Engine-braking device according to claim 1, wherein the control bore and the oil return bore intersect one another with a common intersection line forming an edge of the connecting orifice.

4. Engine-braking device according to claim 2, wherein the control bore and the oil return bore intersect one another with a common intersection line forming an edge of the connecting orifice.

* * * * *